US005972100A

United States Patent [19]

Dumas

[11] Patent Number: 5,972,100

[45] Date of Patent: Oct. 26, 1999

[54] PRETREATMENT OF FILLER WITH CATIONIC KETENE DIMER

[75] Inventor: David Howard Dumas, Wilmington, Del.

[73] Assignee: Hercules Incorporated, Wilmington, Del.

[21] Appl. No.: 07/748,486

[22] Filed: Aug. 22, 1991

Related U.S. Application Data

[63] Continuation of application No. 07/508,156, Apr. 11, 1990, abandoned.

[51] Int. Cl.[6] ..... C09D 11/04; C09C 3/08; D21H 21/16; D21H 17/17

[52] U.S. Cl. ..... 106/501.1; 106/436; 106/464; 106/465; 106/486; 106/487; 162/157.1; 162/157.2; 162/157.4; 162/164.1; 162/168.1

[58] Field of Search ..... 106/436, 464, 106/465, 486, 487, 501; 162/157.1, 157.2, 157.4, 164.1, 168.1

[56] References Cited

U.S. PATENT DOCUMENTS

| | | | |
|---|---|---|---|
| 2,865,743 | 12/1958 | Weisgerber | 162/181.6 |
| 4,115,187 | 9/1978 | Davidson | 162/174 |
| 4,181,567 | 1/1980 | Riddell et al. | 162/168.3 |
| 4,279,794 | 7/1981 | Dumas | 8/189 |
| 4,295,931 | 10/1981 | Dumas | 162/164.3 |
| 4,725,318 | 2/1988 | Minayoshi et al. | 106/465 |
| 4,799,964 | 1/1989 | Harvey et al. | 106/436 |
| 4,925,530 | 5/1990 | Sinclair et al. | 162/181.1 |
| 5,147,507 | 9/1992 | Gill | 162/158 |
| 5,270,076 | 12/1993 | Evers | 427/220 |

FOREIGN PATENT DOCUMENTS

| | | |
|---|---|---|
| 0445953 | 2/1991 | European Pat. Off. . |
| 3035634 | 4/1982 | Germany . |

OTHER PUBLICATIONS

Shin, Dong So; "Studies on Alkaline Paper Making with Alkyl Ketone Dimer . . . " CA 107 vol. 14: 117215t, 1987.

"Effects of Fillers on the Properties of Paper.", Dennison, S.R.; Papeterie, 1973, CA78(22): 138133n.

CA 96(22):183120p; abstract of DE 3035634.

*Primary Examiner*—Mark L. Bell
*Assistant Examiner*—Scott L. Hertzog
*Attorney, Agent, or Firm*—Caesar, Rivise, Bernstein, Cohen & Pokotilow, Ltd.

[57] ABSTRACT

A filler of inorganic particles, cellulose reactive size and cationic dispersing agent is provided, the use of which results in the capability to obtain the desired sizing level practically unaffected by the level of filler addition.

16 Claims, No Drawings

PRETREATMENT OF FILLER WITH CATIONIC KETENE DIMER

This application is a continuation of application Ser. No. 07/508,156, filed Apr. 11, 1990 now abandoned.

FIELD OF THE INVENTION

The present invention relates to novel treated filler and, more particularly, it relates to fillers treated with cationic cellulose reactive sizes.

BACKGROUND OF THE INVENTION

Sizing agents are used in the paper industry to provide water repellency to the paper and board. The need for water repellency is twofold: either to impart water resistance for the end use of the paper or to provide a production advantage to the papermaker. The first is exemplified by a liquid container or a printed sheet. Both require a degree of water repellency to provide their function in the marketplace. The productivity aspect is determined by the need for a controlled uptake of an aqueous liquid added subsequent to the web forming process. Examples are size presses (commonly used on printing and writing papers as well as many board grades), coaters both on and off machine, and calender boxes. If the aqueous pick up of the subsequent coating is excessive the paper machine will have to slow down in order to dry the additional water. Also, the coating will not be held on the surface if there is insufficient sizing and surface properties may suffer.

Inorganic pigments are widely used as fillers in the paper industry. This use is primarily in printing and writing grades where they provide improved optical and printing properties. They also reduce overall costs since most pigments cost less than cellulose pulp. Inorganic fillers also reduce the paper strength so their use is limited to that amount that will produce the needed optical properties without overall degradation of strength. The papermaker is continually striving to increase the level of mineral filler to reduce costs but to maintain good runnability on his machine to increase productivity. If the paper becomes too weak, it may break in process under the stresses and strains of the process. Additionally, the use of increased fillers has a detrimental effect on sizing. As the filler loading is increased the sizing level decreases sometimes rather dramatically. In the sense that sizing is needed to adequately run the paper machine, any upset in sizing will lead to an upset in productivity. The difficulty in sizing high filler loadings is thought to be due to the increased surface area of the fillers relative to the pulp. Since internal sizes work by increasing the contact angle of the surface to be sized, the addition of more surface area causes an increased demand for size. This is especially true of cellulose reactive sizes which are much more efficient than the traditional rosin sizes. An additional problem is the difficulty of retaining both size and filler in highly filled systems. As the level of filler increases, it is more difficult to retain the filler in the web so the filler retention usually decreases. In order to prevent this, retention aids are commonly employed that aid filler retention. As the filler level increases, the need for internal size will also increase.

The object of the present invention is to allow the papermaker to add a wide range of filler loading without seriously affecting the sizing level in the sheet. This would greatly simplify the manufacturing problems of the papermaker who could now concentrate on achieving the optimum balance of strength properties and cost without concern that the sizing level would be adversely affected. In this way, both paper properties and productivity could be maximized independent of each other.

There is much prior art regarding ways to improve the sizability of the filler. Generally, they fall into two categories: (1) use of cationic treatments to improve the retention of filler, and (2) treatment with sizing agents as a method to retain the size.

The use of cationic treatments is a widely used tactic in paper chemical additives, since the pulp fiber is anionic in nature. Cationic additives are attracted to the cellulose pulp and retention of the additive may be improved. This is not so effective with filler particles which are large and thus, not strongly bound by the relatively weak attractive forces of opposite charge attraction. A cationic polymer is smaller and will be relatively, tightly held by the same degree of attraction. Another factor is the fact that most fillers are retained as agglomerated clusters by an entrapment mechanism that occurs by filtration during web formation rather than by individual particles being adsorbed on the cellulose surface.

The other prior art category relates to the use of fillers as carriers of a sizing agent, in particular, ketene dimer (KD). The technology for using KD to size paper had been delayed by the inability to make stable, easily retained dispersions for use by the paper mill. Absorption of KD onto filler particles which were then retained by a filtration or flocculation filtration mechanism was an early method mentioned in the prior art. The effectiveness of these methods was found to be much lower than the now conventional wet end addition of cationic emulsion. In addition, the level of sizing agent was coupled to the level of filler addition so that it was impossible to increase sizing without increasing the filler level and this wasn't usually desired.

Neither of these methodologies, however, addresses the problem we described above; namely, the large loss in sizing efficiency with added levels of filler.

SUMMARY OF THE INVENTION

According to the present invention, there is provided a filler consisting essentially of (a) from about 97 to about 99.9% by weight of inorganic particle selected from the group consisting of calcium carbonate, clay, titanium dioxide, talc and hydrated silica clay; (b) from about 0.025 to about 2.7% by weight of cellulose reactive size selected from the group consisting of ketene dimer having the general formula

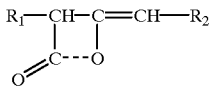

where $R_1$ and $R_2$ are hydrocarbon groups having from 8 to 30 carbon atoms, alkenyl succinic anhydrides wherein the alkenyl group has from 12 to 30 carbon atoms, hydrophobic isocyanates, carbamoyl chlorides and stearic anhydride; (c) from about 0.00625 to about 2.7% by weight of dispersing agent system comprising at least about 95% by weight of cationic dispersing agent selected from the group consisting of cationic natural polymers, cationic synthetic polymers and mixtures thereof.

Also provided, according to the present invention, are processes for the preparation of filler treated with aqueous dispersions of cellulose reactive sizes and cationic dispersing agents, as well as a process for the manufacture of paper and paperboard employing the treated filler of the present invention.

As used herein the term "consisting essentially of" means that the named ingredients are essential, however, other ingredients which do not prevent the advantages of the present invention from being realized can also be included.

DETAILED DESCRIPTION OF THE INVENTION

Surprisingly, it has been found that the addition of cationically dispersed cellulose reactive sizes (CRS), such as ketene dimer (KD) dispersions to the surface of inorganic pigment particles renders these particles such that the sizing level in the sheet is practically unaffected by the level of filler addition. This is in contrast to all the prior art which merely shows improved sizing with the use of specially treated filler. The present invention shows improved sizing too, but in addition it demonstrates that the sizing level can be independent of filler loading level. This has great commercial significance, since the papermaker will be able to control filler loading and sizing independently.

The treatment must be with a cationically dispersed cellulose reactant size, such as KD dispersion. The dispersion can be dispersed with either naturally occurring cationic polymers (such as starch), synthetically produced cationic polymers (such as polyamine resins), or combinations of both types. The preferred embodiment is a combination of both types.

While the above mentioned cellulose reactive sizes are all suitable for use in the present invention, some of the specific description to follow will be in terms of the preferred ketene dimer.

The composition of the dispersions is from about 25 to about 75% by weight of KD on a dry basis with from about 35 to about 55% preferred. The level of naturally occurring cationic polymer varies from 0 to about 35% by weight of the dispersions and the level of synthetic cationic polymer ranges from 0 to about 75% by weight of the dispersions, both on a dry basis. When used together, the natural polymer is from about 10 to about 20% by weight and the synthetic polymer is from about 10 to about 70% by weight of the dispersions, again on a dry basis.

The treatment level can vary over wide ranges. The actual dosage will be determined more by economics than by ability to add the treatment. Typcial ranges of treatment are 0.1 to 2.0% by weight of dry solids of the KD dispersion, based upon the weight of inorganic particles. A preferred range would be 0.3 to 1.0%. The inorganic particles may be treated at any place in the manufacture that is convenient. The best addition point will vary from pigment to pigment depending on the manufacturing procedure. Naturally occurring pigments like clay or ground limestone will be more conveniently treated when the pigment is being dispersed, whereas synthetic pigments like precipitated calcium carbonate may be treated either during or after precipitation.

Inorganic particles suitable for the present invention are selected from the group consisting of calcium carbonate, clay, titanium dioxide, talc and hydrated silica;

Preferred inorganic particles are selected from the group consisting of calcium carbonate, kaolin clay and titanium dioxide.

The most preferred inorganic particles are those of precipitated calcium carbonate.

Cellulose reactive sizes suitable in the present invention are selected from the group consisting of ketene dimer having the general formula

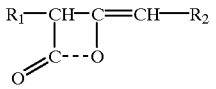

where $R_1$ and $R_2$ are hydrocarbon groups having from 8 to 30 carbon atoms, alkenyl succinic anhydrides wherein the alkenyl group has from 12 to 30 carbon atoms, hydrophobic isocyanates, carbamoyl chlorides and stearic anhydride.

Preferably the cellulose reactive size is selected from the group consisting of ketene dimer wherein the $R_1$ and $R_2$ groups are selected from saturated and monounsaturated hydrocarbon groups having from 12 to 22 carbon atoms and alkenyl succinic anhydrides wherein the alkenyl group has from 12 to 30 carbon atoms.

Most preferably the cellulose reactive size is ketene dimer, wherein the $R_1$ and $R_2$ groups are saturated hydrocarbon groups having from 14 to 16 carbon atoms.

The dispersing agent system employed in the present invention comprises at least about 95% by weight of cationic dispersing agent selected from the group consisting of cationic natural polymers, cationic synthetic polymers and mixtures thereof. When the dispersing agent used is less than 100% cationic dispersing agent the remainder can be anionic and/or nonionic dispersing agent.

Preferably, the cationic dispersing agent is selected from the group consisting of cationic starches, cationic gums, cationic polyamines, cationic polyamides, cationic polyurylenes and mixtures thereof.

Preferably, the weight ratio of cationic synthetic polymers to cationic natural polymers in the dispersing agent is at least about 2 to 1.

Most preferably, the cationic dispersing agent is selected from the group consisting of cationic starches, cationic polyamides and mixtures thereof.

The inorganic particle can be present in the treated filler of the present invention in an amount of from about 97 to about 99.9% by weight, preferably from about 98 to about 99.8% by weight, and most preferably from about 99 to about 99.7% by weight.

The cellulose reactive size can be present in the treated filler of the present invention in an amount of from about 0.025 to about 2.7% by weight, preferably from about 0.1 to about 1.8% by weight, and most preferably from about 0.15 to about 0.9% by weight.

The dispersing agent can be present in an amount of from about 0.00625 to about 2.7% by weight, preferably from about 0.025 to about 1.8% by weight, and most preferably from about 0.0375 to about 0.9% by weight.

After treatment the dispersed filler is stable for subsequent storage and is ready for shipping. In actual use the filler is added in the usual manner. It can be added to the pulp before refining, after refining, or to thin stock just prior to sheet formation. Since the treatment renders the filler cationic the retention system may need to be changed, but experience has not shown any dramatic difference in either filler retention or size retention with the use of the treated filler.

The process for the manufacture of paper and paperboard comprises the following three steps: (1) dispersion of cellulosic fibers, (2) forming a wet laid cellulosic sheet by dewatering said aqueous dispersion and (3) drying the cellulosic sheet to form the desired paper and paperboard product. The treated filler of the present invention can be added to the paper stock dispersion any time prior to sheet formation.

In the following Examples, handsheets were prepared on a Noble and Wood handsheet machine using a 50% hardwood:50% softwood kraft pulp furnish beaten to 500 Canadian Standard Freeness in water containing 100 ppm. hardness and 150 ppm. alkalinity, both expressed as calcium carbonate. The pulp is diluted to 0.25% consistency in the proportioner. The pulp is then diluted further in the deckle box to 0.025% consistency and then the sheet is formed at pH of about 7.5–8.5. Hercon® 48, a cationic KD dispersion, made by Hercules Incorporated, (described in Example 12 of British Patent 1,533,434) was then added to the aliquot taken from the proportioner just prior to dilution of the pulp in the deckle box. The dispersion was added in an amount sufficient to provide about 0.20% of the sizing composition based on the dry weight of the pulp. A closed white water system was used. Formed sheets were wet pressed to 33% solids and then dried at 240° F. on a steam heated drum drier for about 45 seconds. The first four sheets of paper prepared were discarded and the next five were tested for sizing properties. The test results set forth in the Tables were the average of five sheets tested. The handsheets were 40 lb./3000 ft.$^2$ basis weight.

The sizing is measured by the Hercules Size Test (HST) with test solution No. 2 to 80% reflectance. The off-the-machine data (OM) were obtained within three minutes after drying and natural aged (NA) data were obtained after 7 days storage at 72° F. and 50% relative humidity.

The following examples are given for the purpose of illustrating the present invention. All parts and percentages are by weight unless otherwise indicated.

EXAMPLES 1 AND 2 AND COMPARATIVE EXAMPLES C-1 to C-5

Filler Treatment Procedure:

Klondyke clay was diluted to 20% solids in water and was dispersed in a Waring blender on high speed in a plastic container. Dispersant A or Dispersion A, as indicated in the Table, was then added and agitation continued for 2 minutes. The slurries were either used immediately or were reagitated prior to addition to the size crock.

The results obtained after handsheet preparation are summarized in Table I. All ingredients are expressed as solids, based upon the weight of paper.

TABLE I

| Example No. | % Clay Added | % Ash | Filler Treatment | HST, sec. OM | HST, sec. NA |
|---|---|---|---|---|---|
| C-1 | 0 | 0.3 | — | 340 | 469 |
| C-2 | 10 | 8.3 | — | 148 | 156 |
| C-3 | 20 | 16.3 | — | 2 | 3 |
| C-4 | 10 | 8.3 | Dispersant A(1) | 137 | 175 |
| C-5 | 20 | 16.7 | Dispersant A | 4 | 5 |
| Ex. 1 | 10 | 8.2 | Dispersion A(2) | 230 | 275 |
| Ex. 2 | 20 | 16.3 | Dispersion A | 24 | 27 |

(1)Polyamino/polyamide cationic thermosetting resin.
(2)A cationic KD dispersion containing 36% by weight of solids of a mixed ketene dimer which is prepared from 55% by weight of palmitic acid and 45% by weight of stearic acid and wherein the cationic dispersing agent is Dispersant A.

These examples show that treatment of clay filler provides improved sizing over the control (no treatment) and over a cationic resin treatment (Dispersant A). Two levels of filler were added, 10% and 20% which are typical ranges often used in commerce. Comparison of the first three runs shows the normal effect of filler addition; namely, the sizing decreases dramatically from 469 sec. penetration resistance to 3 seconds. Treatment of the filler with cationic resin shows only a very marginal increase over the untreated controls. In contrast cationic KD treated runs gave dramatically better sizing at both the 10% and 20% levels of filler addition.

EXAMPLES 3 AND 4 AND COMPARATIVE EXAMPLES C-6 to C-8

Filler treatment followed the procedure described in Examples 1 and 2. The results obtained after handsheet preparation are summarized in Table II.

TABLE II

| Example No. | % Albaglos SF(1) Filler Added | Filler Treatment | HST, sec. NA | Opacity | % Ash |
|---|---|---|---|---|---|
| C-6 | None | — | 400 | 74.5 | 0.35 |
| C-7 | 10 | — | 75 | 84.4 | 5.11 |
| C-8 | 20 | — | 3 | 88.1 | 9.83 |
| Ex. 3 | 10 | Dispersion B(2) | 116 | 84.1 | 5.29 |
| Ex. 4 | 20 | Dispersion B | 16 | 88.0 | 9.29 |

(1)Precipitated $CaCO_3$ made by Pfizer Inc. having an average particle size of about 0.73 m.
(2)A cationic KD dispersion containing 47% by weight of solids of a mixed ketene dimer which is prepared from 55% by weight of palmitic acid and 45% by weight of stearic acid and wherein the cationic dispersing agent is a cationic waxy maize corn starch with a nitrogen content of greater than 0.2%.

This example demonstrates the improved sizing effect obtained by treating precipitated $CaCO_3$ filler with cationic KD dispersion. Comparing the untreated filler runs, one can see the usual loss in sizing as the filler level is increased.

The ash and opacity data show that there is no effect of the filler treatment on either of these properties. This implies that both the overall ash retention as well as the optical efficiency of the filler is unchanged.

DESCRIPTION OF KALAMAZOO LAB FORMER (KLF)

The KLF is a miniature papermachine designed to simulate a commercial Fourdrinier, including stock preparation, refining and storage. A 70% Weyerhauser Bleached Kraft/30% Rayonier Bleached Kraft pulp is dispersed in standard hard water as described in Example 1. The pulp is refined at 2.5% consistency in a double disc refiner by recirculation to a freeness of 500 CSF. The stock is then pumped to a machine chest where it is diluted with fresh water to approximately 1.0% solids.

The stock is fed by gravity from the machine chest to a constant-level stock tank. From here the stock is pumped to a series of in-line mixers (mix boxes—"MB") where wet end additives are added. There are 4 mixing (additive) stations, each with its own in-line mixer. The filler is added first, to mix box #1. It is followed by cationic potato starch, Stalok® 400, made by Staley, Inc., added to the 2nd mix box at 0.75% dry basis. The internal size, is added to the third mix box as indicated in the individual examples. Finally, an anionic polyacrylamide retention aid, Reten® 523, made by Hercules Incorporated, is added to the 4th mixing station at 0.0375%. After passing through the mix boxes, the stock enters the fan pump where it is diluted with white water to about 0.2% solids.

The stock is pumped from the fan pump to a flow spreader and then to the slice, where it is deposited onto the 12-inch wide Fourdrinier wire. Immediately after its deposition on the wire, the sheet is vacuum dewatered via two vacuum boxes; couch consistency is normally 14 to 15%.

The wet sheet is transferred from the couch to a motor driven wet pickup felt. At this point, water is removed from the sheet and the felt by vacuum uhle boxes operated from a vacuum pump. The sheet is further dewatered in a single felted press and leaves the press section at 38 to 40% solids.

The dryer section is comprised of seven steel drum dryers. Both top and bottom sections are felted. The temperatures of the dryers can be independently varied from 100 to 240° F. The sheet is dried to 3 to 5% moisture content at the reel.

EXAMPLES 5 TO 10 AND COMPARATIVE EXAMPLES C-9 TO C-11

Filler Treatment:

Filler was dispersed at 15% solids 24 hours prior to papermaking. The treatment is added to the filler on the same day as papermaking, using a Lightning mixer to agitate the dispersion. Agitation was continued for 5 minutes after treating the filler. The level of treatment is described in the individual examples to follow.

Paper sheets were made on the KLF following the procedure described above. As the internal size all runs contain 0.08% by weight of solids of Hercon® 70, a cationic ketene dimer dispersion available commercially from Hercules Incorporated.

Filler and treatment levels, and the results obtained are summarized in Table III.

TABLE III

| Example No. | % Albacar 5970[1] Filler Added | Filler Treatment | HST, sec. NA |
|---|---|---|---|
| C-9 | 10 | — | 174 |
| C-10 | 20 | — | 28 |
| C-11 | 30 | — | 7 |
| Ex. 5 | 10 | 0.23% Dispersion C[2] | 226 |
| Ex. 6 | 20 | 0.23% Dispersion C | 172 |
| Ex. 7 | 30 | 0.23% Dispersion C | 109 |
| Ex. 8 | 10 | 0.46% Dispersion C | 257 |
| Ex. 9 | 20 | 0.46% Dispersion C | 265 |
| Ex. 10 | 30 | 0.46% Dispersion C | 283 |

[1]Precipitated $CaCO_3$ made by Pfizer Inc. having an average particle size of about 2 m.
[2]A cationic KD dispersion containing 45% by weight of solids of a mixed ketene dimer which is prepared from 55% by weight of palmitic acid and 45% by weight of stearic acid and wherein the cationic dispersion agent is a polyamine resin.

These examples show the importance of treating the filler at high filler loadings. The untreated filler shows the usual loss in sizing. The treated fillers show essentially no loss even though the filler level is increased threefold from 10 to 30%. As the level of filler treatment is increased, the sizing actually can increase as the filler level increases.

EXAMPLES 11 TO 19 AND COMPARATIVE EXAMPLES C-12 TO C-14

Paper sheets were made on the KLF following the procedure described above. As the internal size all runs contain 0.11% by weight of solids of Hercon® 70, a cationic ketene dimer dispersion available commercially from Hercules Incorporated.

Filler and treatment levels and the results obtained are summarized in Table IV.

TABLE IV

| Example No. | % Albacar 5970 Filler Added | Filler Treatment | HST, sec. NA |
|---|---|---|---|
| C-12 | 10 | — | 210 |
| C-13 | 20 | — | 154 |
| C-14 | 30 | — | 27 |
| Ex. 11 | 10 | 0.23% Dispersion B | 219 |
| Ex. 12 | 20 | 0.23% Dispersion B | 284 |
| Ex. 13 | 30 | 0.23% Dispersion B | 203 |
| Ex. 14 | 10 | 0.46% Dispersion B | 238 |
| Ex. 15 | 20 | 0.46% Dispersion B | 361 |
| Ex. 16 | 30 | 0.46% Dispersion B | 338 |
| Ex. 17 | 10 | 0.69% Dispersion B | 203 |

TABLE IV-continued

| Example No. | % Albacar 5970 Filler Added | Filler Treatment | HST, sec. NA |
|---|---|---|---|
| Ex. 18 | 20 | 0.69% Dispersion B | 480 |
| Ex. 19 | 30 | 0.69% Dispersion B | 426 |

These examples show the same effect as shown in Examples 5 to 10, except obtained at a higher internal sizing level.

EXAMPLES 20 AND 21 AND COMPARATIVE EXAMPLE C-15

Paper sheets were made on the KLF following the procedure described above. As the internal size all runs contain 0.08% by weight of solids of alkenyl succinic anhydride (ASA) dispersed with 0.16% by weight of solids Stalok 400 cationic starch at 2000 psi at room temperature. The dispersion was kept at 20° C. prior to use and was used within 3 hours of its preparation. The ASA was Fibran® 70, available from National Starch Co.

Filler and treatment levels and the results obtained are summarized in Table V.

TABLE V

| Example No. | % Albacar 5970 Filler Added | Filler Treatment | HST, sec. NA |
|---|---|---|---|
| C-15 | 20 | — | 1 |
| Ex. 20 | 20 | 0.08% Dispersion B | 110 |
| Ex. 21 | 20 | 0.05% Dispersion C[1] | 41 |

[1]Dispersion C is a cationic KD dispersion containing 74% by weight of solids of a mixed KD which is prepared from 55% by weight of palmitic acid and 45% by weight of stearic acid and wherein the cationic dispersing agent is a cationic waxy maize cornstarch with a nitrogen content of greater than 0.2%.

These examples show that both types of cationically dispersed KD dispersions give greatly improved sizing when used with ASA as the internal size.

EXAMPLES 22 AND 23 AND COMPARATIVE EXAMPLE C-16

Paper sheets were made on the KLF following the procedure described above. The runs were internally sized as in Examples 5 to 10.

Filler and treatment levels and the results obtained are summarized in Table VI.

TABLE VI

| Example No. | % Albacar 5970 Filler Added | Filler Treatment | HST, sec. NA |
|---|---|---|---|
| C-16 | 20 | — | 53 |
| Ex. 22 | 20 | 0.6% ASA[1] | 112 |
| Ex. 23 | 20 | 1.27% ASA | 277 |

[1]ASA dispersion described as the internal size in Examples 20 and 21.

These examples show the improvement obtained when the filler is treated with ASA.

EXAMPLE 24 AND COMPARATIVE EXAMPLES C-17 AND C-18

Paper sheets were made on the KLF following the procedure described above. All runs were internally sized as in Examples 5 to 10.

Filler and treatment levels and the results obtained are summarized in Table VII.

TABLE VII

| Example No. | % Albacar 5970 Filler Added | Fiiler Treatment | HST, sec. NA |
|---|---|---|---|
| C-17 | 20 | — | 53 |
| C-18 | 20 | 0.4% Nalco 7541[(1)] | 46 |
| Ex. 24 | 20 | 0.4% Dispersion B | 416 |

[(1)]A cationic polyamine resin, commercially available from Nalco Chemicals, made from dimethyl amine and epichlorohydrin.

This example shows that the cationic polyamine resin treatment of the filler did not result in any improvement in sizing. On the other hand, treatment of the filler with the cationic KD dispersion resulted in a significant improvement in sizing.

I claim:

1. A filler consisting essentially of (a) from about 97 to about 99.9% by weight of inorganic particle selected from the group consisting of calcium carbonate, clay, titanium dioxide, talc and hydrated silica; (b) from about 0.025 to about 2.7% by weight of cellulose reactive size selected from the group consisting of ketene dimer having the general formula

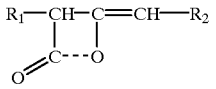

where $R_1$ and $R_2$ are hydrocarbon groups having from 8 to 30 carbon atoms, alkenyl succinic anhydrides wherein the alkenyl group has from 12 to 30 carbon atoms, hydrophobic isocyanates, carbamoyl chlorides and stearic anhydride; (c) from about 0.00625 to about 2.7% by weight of dispersing agent system comprising at least about 95% by weight of cationic dispersing agent selected from the group consisting of cationic natural polymers, cationic synthetic polymers and mixtures thereof.

2. The filler of claim 1, wherein the inorganic particle is selected from the group consisting of calcium carbonate, kaolin clay and titanium dioxide and is present in an amount of from about 98 to about 99.8% by weight.

3. The filler of claim 1, wherein the cellulose reactive size is selected from the group consisting of ketene dimer wherein the $R_1$ and $R_2$ groups are selected from saturated and monounsaturated hydrocarbon groups having from 12 to 22 carbon atoms and alkenyl succinic anhydrides wherein the alkenyl group has from 12 to 30 carbon atoms and said reactive cellulose size is present in an amount of from about 0.1 to about 1.8% by weight.

4. The filler of claim 1, wherein the cationic dispersing agent is selected from the group consisting of cationic starches, cationic gums, cationic polyamines, cationic polyamides, cationic polyurylenes and mixtures thereof wherein the cationic synthetic polymer to cationic natural polymer weight ratio is at least about 2 to 1, said cationic dispersing agent being present in an amount of from about 0.025 to about 1.8% by weight.

5. The filler of claim 2, wherein the cellulose reactive size is selected from the group consisting of the ketene dimer wherein the $R_1$ and $R_2$ groups are selected from saturated and monounsaturated hydrocarbon groups having from 12 to 22 carbon atoms and alkenyl succinic anhydrides wherein the alkenyl group has from 12 to 30 carbon atoms and said reactive cellulose size is present in an amount of from about 0.1 to about 1.8% by weight and the cationic dispersing agent is selected from the group consisting of cationic starches, cationic gums, cationic polyamines, cationic polyamides, cationic polyurylenes and mixtures thereof wherein the cationic synthetic polymer to cationic natural polymer weight ratio is at least about 2 to 1, said cationic dispersing agent being present in an amount of from about 0.025 to about 1.8% by weight.

6. The filler is claim 5, wherein the inorganic particle is precipitated calcium carbonate and is present in an amount of from about 99 to about 99.7% by weight.

7. The filler of claim 5, wherein the cellulose reactive size is ketene dimer, wherein the $R_1$ and $R_2$ groups are saturated hydrocarbon groups having from 14 to 16 carbon atoms and said ketene dimer is present in an amount of from about 0.15 to about 0.9% by weight.

8. The filler of claim 5, wherein the cationic dispersing agent is selected from the group consisting of cationic starches, cationic polyamides and mixtures thereof wherein the cationic synthetic polymer to cationic natural polymer weight ratio is at least about 2 to 1, said cationic dispersing agent being present in an amount of from about 0.0375 to about 0.9% by weight.

9. The filler of claim 6, wherein the cellulose reactive size is ketene dimer, wherein the $R_1$ and $R_2$ groups are saturated hydrocarbon groups having from 14 to 16 carbon atoms and said ketene dimer is present in an amount of from about 0.15 to about 0.9% by weight and the cationic dispersing agent is selected from the group consisting of cationic starches, cationic polyamines and mixtures thereof wherein the cationic synthetic polymer to cationic natural polymer weight ratio is at least about 2 to 1, said cationic dispersing agent being is present in an amount of from about 0.0375 to about 0.9% by weight.

10. A process for the preparation of treated filler consisting essentially of (i) dispersing inorganic particles selected from the group consisting of calcium carbonate, clay, titanium dioxide, talc and hydrated silica in water at a solids content of from about 10 to about 80% by weight; (ii) adding under agitation an aqueous dispersion consisting essentially of (a) from about 1 to about 30% by weight of cellulose reactive size selected from the group consisting of ketene dimer having the general formula

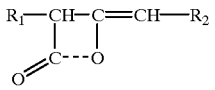

where $R_1$ and $R_2$ are hydrocarbon groups having from 8 to 30 carbon atoms, alkenyl succinic anhydrides wherein the alkenyl group has from 12 to 30 carbon atoms, hydrophobic isocyanates, carbamoyl chlorides and stearic anhydride, and (b) from about 10 to about 200%, based upon the weight of cellulose reactive size, of dispersing agent system comprising at least about 95% by weight of cationic dispersing agent selected from the group consisting of cationic natural polymers, cationic synthetic polymers and mixtures thereof, in an amount such that the cellulose reactive size solids added is from about 0.025 to about 2.7%, based upon the weight of inorganic particle.

11. The process of claim 10, wherein the inorganic particles are selected from the group consisting of calcium carbonate, kaolin clay and titanium dioxide and are dispersed in water at a solids content of from about 15 to about 50% by weight, the cellulose reactive size is selected from the group consisting of ketene dimer wherein the $R_1$ and $R_2$ groups are selected from saturated and monounsaturated hydrocarbon groups having from 12 to 22 carbon atoms and alkenyl succinic anhydrides wherein the alkenyl group has from 12 to 30 carbon atoms and said reactive cellulose size is present in an amount of from about 0.1 to about 1.8%, based upon the weight of inorganic particle, and the cationic dispersing agent is selected from the group consisting of cationic starches, cationic gums, cationic polyamines, cationic polyamides, cationic polyurylenes and mixtures thereof wherein the cationic synthetic polymer to cationic natural polymer weight ratio is at least about 2 to 1, said cationic dispersing agent being present in an amount of from about 15 to about 150%, based upon the weight of cellulose reactive size.

12. The process of claim 11, wherein the inorganic particles are precipitated calcium carbonate and are dispersed in water at a solids content of from about 20 to about 40% by weight, the cellulose reactive size is ketene dimer wherein the $R_1$ and $R_2$ groups are saturated hydrocarbon groups having from 14 to 16 carbon atoms and said ketene dimer is present in an amount of from about 0.15 to about 0.9%, based upon the weight of inorganic particle, and the cationic dispersing agent is selected from the group consisting of cationic starches, cationic polyamines and mixtures thereof wherein the cationic synthetic polymer to cationic natural polymer weight ratio is at least about 2 to 1, said cationic dispersing agent being present in an amount of from about 25 to about 100%, based upon the weight of dimer.

13. A process for the preparation of treated filler consisting essentially of adding under agitation to synthetic inorganic particles selected from the group consisting of precipitated calcium carbonate and titanium dioxide, either during or after precipitation, an aqueous dispersion consisting essentially of (a) from about 1 to about 30% by weight of cellulose reactive size selected from the group consisting of ketene dimer having the general formula

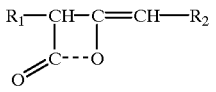

where $R_1$ and $R_2$ are hydrocarbon groups having from 8 to 30 carbon atoms, alkenyl succinic anhydrides wherein the alkenyl group has from 12 to 30 carbon atoms, hydrophobic isocyanates, carbamoyl chlorides and stearic anhydride and (b) from about 10 to about 200%, based upon the weight of cellulose reactive size, of dispersing agent system comprising at least about 95% by weight of cationic dispersing agent selected from the group consisting of cationic natural polymers, cationic synthetic polymers and mixtures thereof, in an amount such that the cellulose reactive size solids added is from about 0.025 to about 2.7%, based upon the weight of inorganic particle.

14. The process of claim 13, wherein the cellulose reactive size dispersion is added to the synthetic inorganic particles after precipitation thereof, the synthetic inorganic particles are selected from the group consisting of precipitated calcium carbonate and titanium dioxide, the cellulose reactive size is selected from the group consisting of ketene dimer wherein the $R_1$ and $R_2$ groups are selected from saturated and monounsaturated hydrocarbon groups having from 12 to 22 carbon atoms and alkenyl succinic anhydrides wherein the alkenyl group has from 12 to 30 carbon atoms and said reactive cellulose size is present in an amount of from about 0.1 to about 1.8%, based upon the weight of inorganic particle, and the cationic dispersing agent is selected from the group consisting of cationic starches, cationic gums, cationic polyamines, cationic polyamides, cationic polyurylenes and mixtures thereof wherein the cationic synthetic polymer to cationic natural polymer weight ratio is at least about 2 to 1, said cationic dispersing agent being present in an amount of from about 15 to about 150%, based upon the weight of cellulose reactive size.

15. The process of claim 14, wherein the synthetic inorganic particles are precipitated calcium carbonate, the cellulose reactive size is ketene dimer wherein the $R_1$ and $R_2$ groups are saturated hydrocarbon groups having from 14 to 16 carbon atoms and said ketene dimer is present in an amount of from about 0.15 to about 0.9%, based upon the weight of inorganic particle, and the cationic dispersing agent is selected from the group consisting of cationic starches, cationic polyamines and mixtures thereof wherein the cationic synthetic polymer to cationic natural polymer weight ratio is at least about 2 to 1 present in an amount of from about 25 to about 100%, based upon the weight of dimer.

16. In a process for the manufacture of paper and paperboard, said process comprising forming an aqueous dispersion of cellulosic fibers, forming a wet laid cellulosic sheet by dewatering said aqueous dispersion and drying the cellulosic sheet to form the desired paper and paperboard product, the improvement comprising adding to the paper stock dispersion any time prior to sheet formation the filler of claims 1, 5 or 9.

* * * * *